US010325451B2

(12) United States Patent
Armstrong

(10) Patent No.: US 10,325,451 B2
(45) Date of Patent: Jun. 18, 2019

(54) METHOD FOR SIMULATING A TRADITIONAL CASINO KENO GAME EXPERIENCE USING A DEDICATED SET OF PLAYING CARDS

(71) Applicant: Kard Keno, LLC, Roseville, CA (US)

(72) Inventor: Richard J. Armstrong, Folsom, CA (US)

(73) Assignee: Kard Keno, LLC, Roseville, CA (US)

( * ) Notice: Subject to any disclaimer, the term of this patent is extended or adjusted under 35 U.S.C. 154(b) by 0 days.

(21) Appl. No.: 15/474,887

(22) Filed: Mar. 30, 2017

(65) Prior Publication Data

US 2017/0287284 A1 Oct. 5, 2017

Related U.S. Application Data

(60) Provisional application No. 62/290,317, filed on Mar. 31, 2016.

(51) Int. Cl.

| | |
|---|---|
| ***A63F 1/12*** | (2006.01) |
| ***G07F 17/32*** | (2006.01) |
| ***A63F 1/14*** | (2006.01) |
| *A63F 9/24* | (2006.01) |

(52) U.S. Cl.

CPC ..... *G07F 17/3293* (2013.01); *A63F 1/12* (2013.01); *A63F 1/14* (2013.01); *G07F 17/3213* (2013.01); *G07F 17/3223* (2013.01); *G07F 17/3239* (2013.01); *G07F 17/3288* (2013.01); *A63F 2009/2425* (2013.01); *A63F 2009/2485* (2013.01)

(58) Field of Classification Search

CPC ..... G07F 17/3293; G07F 17/3213; G07F 17/3223; G07F 17/3239; G07F 17/3288

See application file for complete search history.

(56) References Cited

U.S. PATENT DOCUMENTS

| | | | | |
|---|---|---|---|---|
| 8,066,562 | B1 * | 11/2011 | Thompson | G07F 17/3293 463/17 |
| 2007/0021186 | A1 * | 1/2007 | Hamud | B65D 71/20 463/18 |
| 2012/0264495 | A1 * | 10/2012 | Amaitis | G07F 17/3267 463/10 |
| 2013/0296008 | A1 * | 11/2013 | Hardison | A63F 1/02 463/11 |
| 2014/0309012 | A1 * | 10/2014 | Anderson | G07F 17/34 463/20 |

(Continued)

*Primary Examiner* — Tramar Y Harper
*Assistant Examiner* — Jeffrey K Wong

(57) ABSTRACT

A method and system for a card-based game with simulates a traditional keno game through the use of a specially designed deck of playing cards. The system includes a computer, a scanner, a specialty card shoe, and the specially designed deck of cards. The method includes first shuffling the deck of cards by the specialty card shoe. Next, a card is drawn from the deck of cards and scanned, thus extracting a unique number that is associated with a spot on a traditional Keno card. The unique number is then associated and indicated to a spot on a simulated Keno card by the computer. This process is repeated for twenty iteration to compile winning numbers. The winning numbers are then compared against guessed spots associated with a user account to identify a set of matching spots. A primary payout transaction is managed based on the set of matching spots.

8 Claims, 11 Drawing Sheets

(56) References Cited

U.S. PATENT DOCUMENTS

| | | | | |
|---|---|---|---|---|
| 2016/0101347 | A1* | 4/2016 | Merati | G07F 17/326<br>463/16 |
| 2016/0267741 | A1* | 9/2016 | Humphrey | G07F 17/329 |

* cited by examiner

METHOD FOR SIMULATING A TRADITIONAL CASINO KENO GAME EXPERIENCE USING A DEDICATED SET OF PLAYING CARDS

The current application claims a priority to the U.S. Provisional Patent application Ser. No. 62/290,317 filed on Mar. 31, 2016.

FIELD OF THE INVENTION

The present invention relates generally to casino and card games. More specifically, the present invention is a system and method for simulating a traditional keno game experience using a dedicated set of playing cards.

BACKGROUND OF THE INVENTION

The traditional game of keno is played with a machine that randomly mixes numbered balls, similar to those used in bingo and lotteries, or via an electronic random number generator for the selection of twenty random numbers. Players use keno cards to select between one and twenty numbers by marking the card and selecting the amount of their wager and the number of draws they want the card to be valid for. Various types of bets are possible. A bet is a prediction by the player of which numbers will be randomly drawn in a particular keno game drawing. To win at keno, a player needs to accurately predict or "catch" a predetermined amount of the numbers randomly drawn in a particular keno game draw known as "spots" and is determined by the game return tables offered by the particular casino and the type of ticket the player bets.

To play the traditional game of keno, the players first bet using individually completed keno cards and then the dealer conducts the random drawing of numbers. The numbers one through eighty are randomly mixed by a machine and selects twenty of the numbers at random. The twenty randomly selected numbers represent the selected possible winning numbers in a particular game and thus dictate which players win and which players lose. Players with winning keno cards redeem their cards and the dealer pays out on the winning cards.

Gaming regulations sometimes restrict casinos to only games that employ cards to determine the outcome of a game and do not allow the casinos to operate games that are otherwise not authorized. However, casinos that are thus restricted still would like to be able to provide a keno-themed game experience to their customers. The present invention allows casinos to provide such an experience within their gaming restrictions through a house-banked card game methodology. Specifically, the present invention substitutes a shuffler and special deck of cards for the machine that mixes numbered balls, or an electronic random number generator that are employed in a traditional keno game.

DETAIL DESCRIPTIONS OF THE INVENTION

All illustrations of the drawings are for the purpose of describing selected versions of the present invention and are not intended to limit the scope of the present invention.

First Description of Present Invention

The present invention generally relates to casino and card games. More specifically, the present invention is a method for simulating a traditional casino keno game experience using a specially designed deck of cards. The present invention implements a traditional keno game in the form of cards. A method and a system are used to achieve this. The method is a sequence of steps, executed in a specific order to simulate a traditional keno game with a dedicated and specialized deck of cards. The system comprises the physical components necessary for the method of the present invention.

Figure 1:
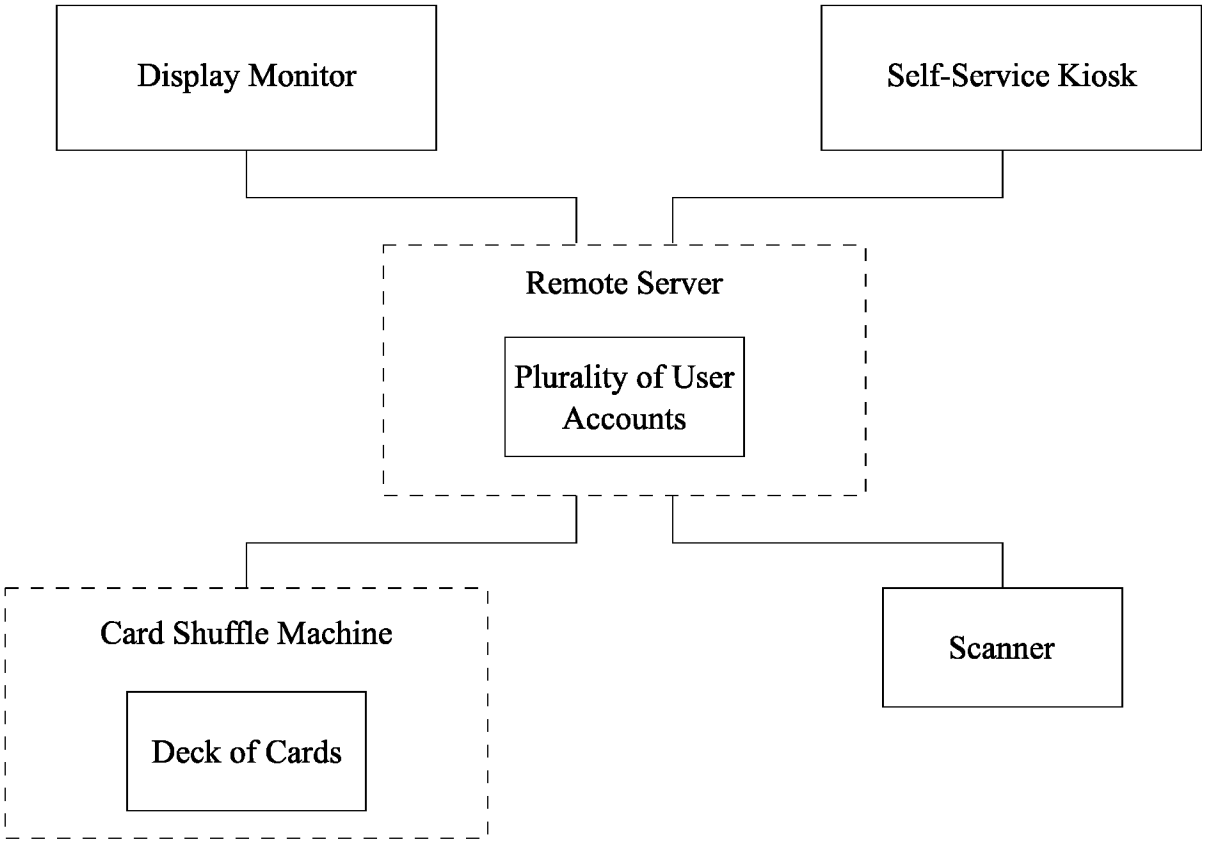
FIG. 1 is a schematic diagram of the present invention.

The present invention may be implemented for a single or a multitude of players. For simplicity purposes, the general method of the present invention is described for a single player, hereafter referred to as a user account. The user account is associated with a plurality of guessed spots that represents the player's guesses for the winning number (Step A). Referring to FIG. 1, the system comprises a deck of cards, a remote server, a card shuffle machine, a scanner, an at least one display monitor, and a self-service kiosk. The deck of cards represents and replaces traditional plastic balls used in keno games; each of the cards is associated with a number (Step B). More specifically, the deck of cards includes 80 cards, wherein each of the cards is associated with a number between one and 80. There are no repeating numbers within the deck of cards. The size, design, and color of the cards is subject to change depending on the needs and preferences of the user(s). The remote server manages the user account and is communicably coupled to, the card shuffle machine, the scanner, the display monitor, and the self-service kiosk (Step C). The card shuffle machine randomly rearranges the deck of cards. Additionally, the card shuffle machine simulates dispensing random plastic balls in a traditional keno game by dispensing a random card.

The scanner extracts information associated with each of the cards, i.e. the number associated with each of the pulled cards. This information is then utilized by the remote server to determine if the user account won or lost. The display monitor graphically displays various information from the present invention including, but not limited to, drawn numbers/cards, progressive pot value, timer, and other relevant information. It is preferred that the drawn numbers are displayed on a traditional keno card layout in order to simulate a traditional keno game. A variety of devices may be used as the display monitor including, but not limited to, flat panel liquid crystal displays (LCD), light-emitting diode (LED) displays, plasma screens, and other electronic display monitors. The self-service kiosk acts as the physical interface for the players of the present invention. Through the self-service kiosk, the player may create the user account within the present invention and use said account to play. In particular, through the user account and the self-service kiosk, the player may submit his or her number guesses, associated bets, check game and personal bet status, submit payment, and receive monetary winnings.

Figure 2:
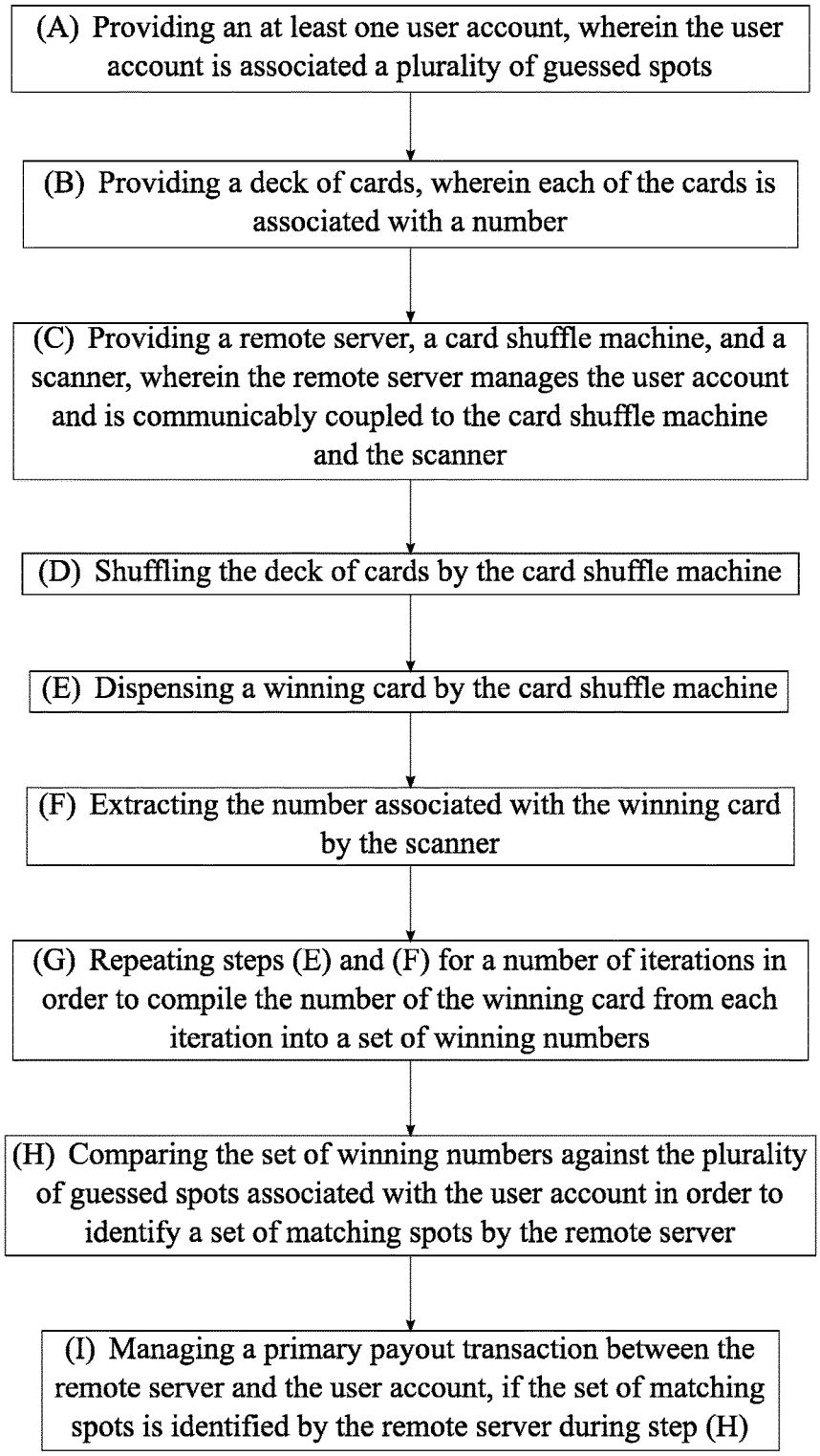
FIG. 2 is a flowchart depicting the overall process for the present invention

The overall method of the present invention is depicted in FIG. 2. Prior to the initiating the game, the player utilizes the self-service kiosk in order to register and submit his or her guesses, i.e. the plurality of guessed spots. Once the game is initiated, by the remote server or a dealer, the deck of cards is first shuffled by the card shuffle machine (Step D). This is equivalent to the ball machine and random number generators used in traditional keno games. Next, a winning card is dispensed by the card shuffle machine (Step E), mimicking a random ball being chosen/dispensed in a traditional keno game. Next, the number associated with the winning card is extracted by the scanner (Step D). More specifically, the dealer passes the winning card by the scanner in order to extract information from the winning card, i.e. the number associated with the winning card. This process, Steps E and F, are then repeated for a number of iterations in order to compile the number of the winning card from each iteration into a set of winning numbers (Step G). In other words, each iteration corresponds to a different card being dispensed and scanned. Additionally, for each iteration, the winning card is also physically placed onto a drawn card space on the game table for players and surveillance to see, this is done by the dealer. Similar to the traditional keno game, the number of iterations executed during Step G is preferably 20 iterations, thus producing 20 numbers within the set of winning numbers. Next, the set of winning numbers are used to determine and identify if the user account, the player, won or lost their respective bet. The set of winning numbers is compared against the plurality of guessed spots associated with the user account in order to identify a set of matching spots by the remote server (Step H). The set of matching spots includes guessed spots submitted by the user account that are present within the set of winning numbers.

Figure 3:
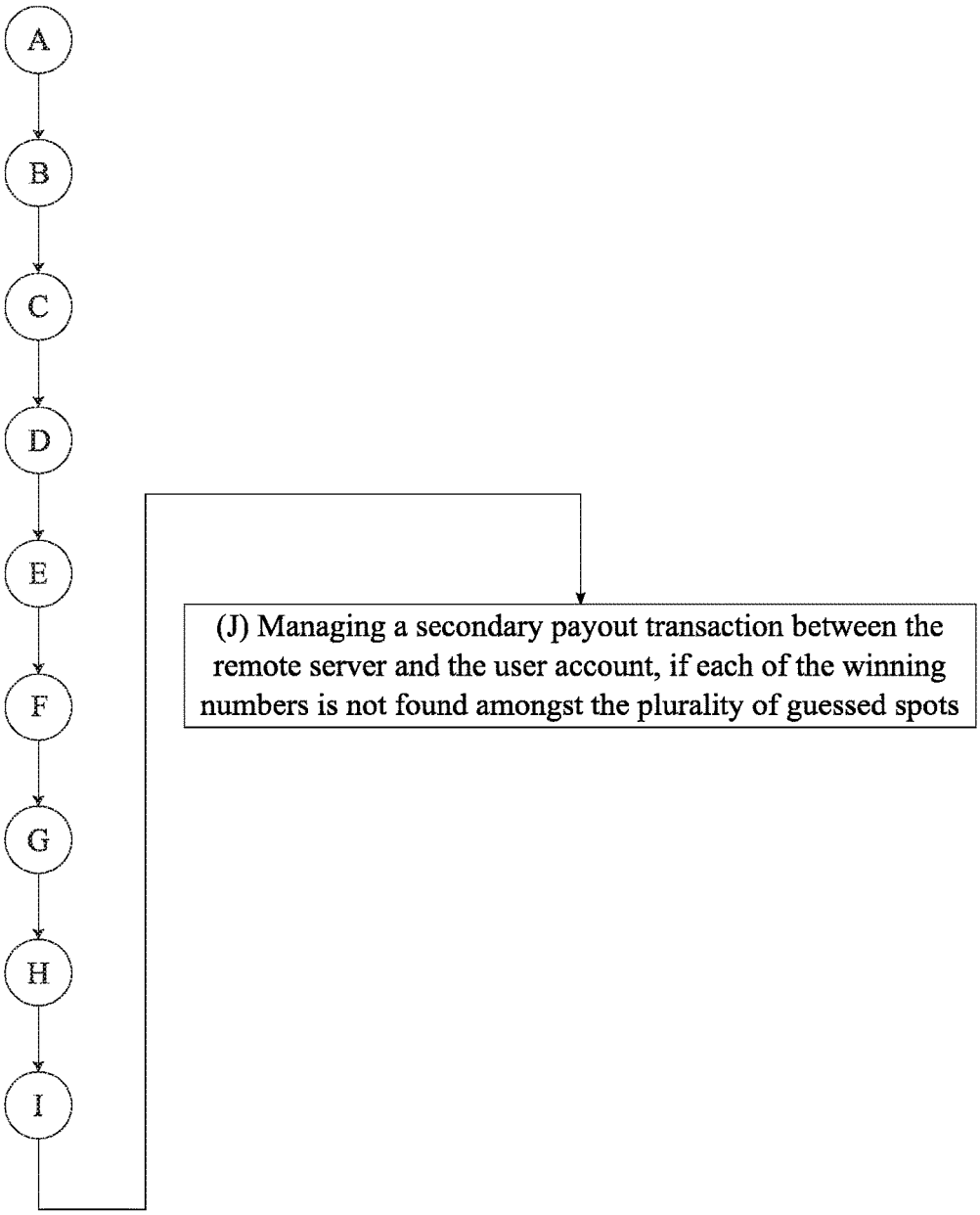
FIG. 3 is a flowchart depicting the steps necessary to identify and perform a secondary payout transaction.

Finally, the last step within the overall process of the present invention is managing payouts. More specifically, if the set of matching spots is identified by the remote server during Step H, then a primary payout transaction is managed in between the remote server and the user account. The value of the primary payout transaction is dependent on a variety of factors including, but not limited to the number of matching spots, which numbers within the set of winning numbers were identified, the play options the user account chose, and other relevant information. In the preferred embodiment of the present invention, the value of the primary payout transaction is determined based on traditional rules and regulations of a keno game. One of the regulations for traditional keno games is rewarding players for not guessing any of the winning numbers. For this regulation, if each of the winning numbers is not found amongst the plurality of guessed spots, then a secondary payout transaction is managed between the remote server and the user account (Step J) as seen in FIG. 3. Often the value of the secondary payout transaction is significantly less than the value of the primary payout transaction.

Figure 5:
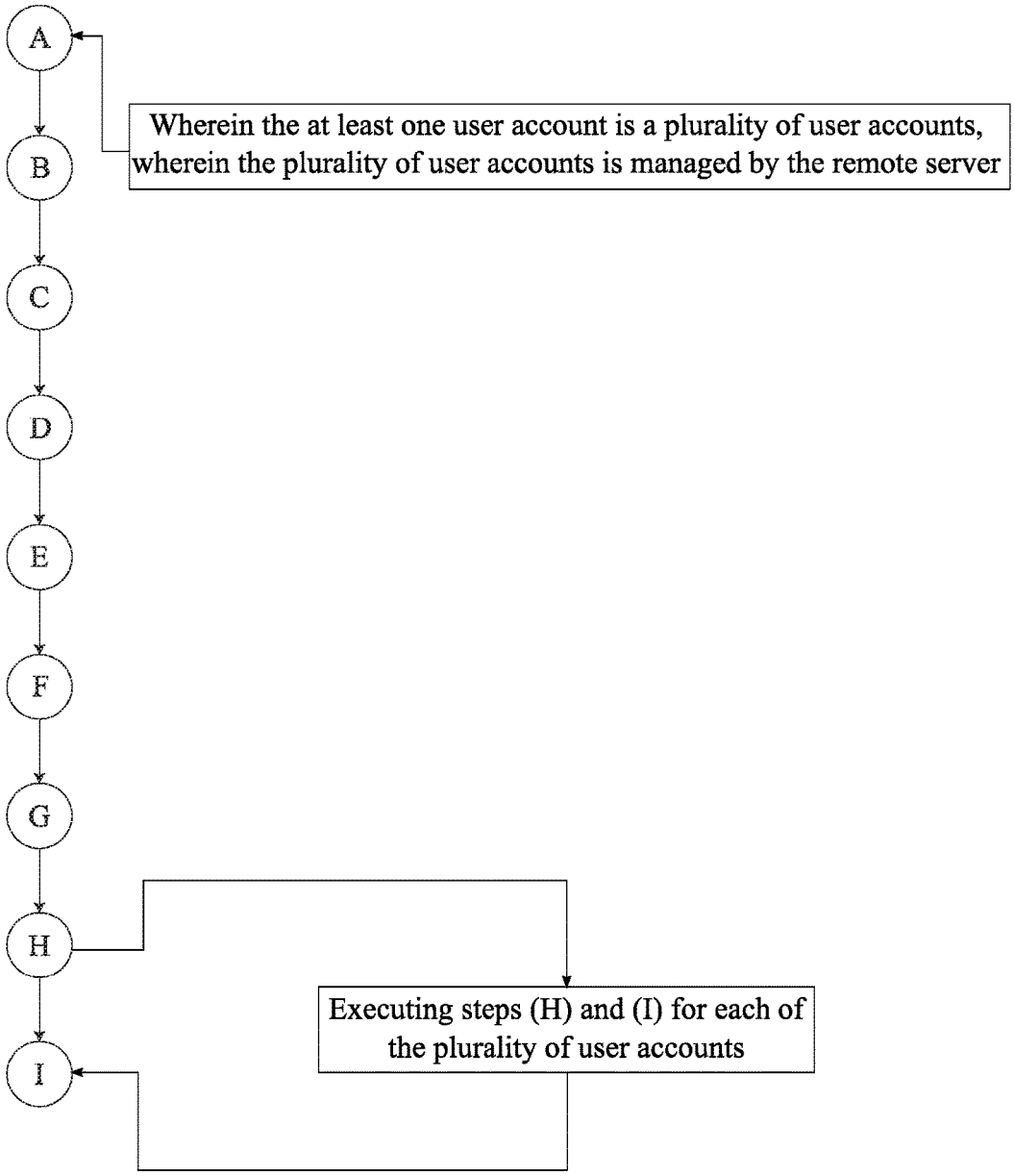
FIG. 5 is a flowchart depicting the steps necessary for a plurality of user accounts to participate in the present invention.

Referring to FIG. 5, the present invention can and is designed to be played by a multitude of players. In regards to the overall process, the present invention is designed for a plurality of user accounts. This is accomplished by executing Steps H through I for each of the plurality of user accounts, wherein each of the plurality of user accounts represents a specific player.

Figure 4:
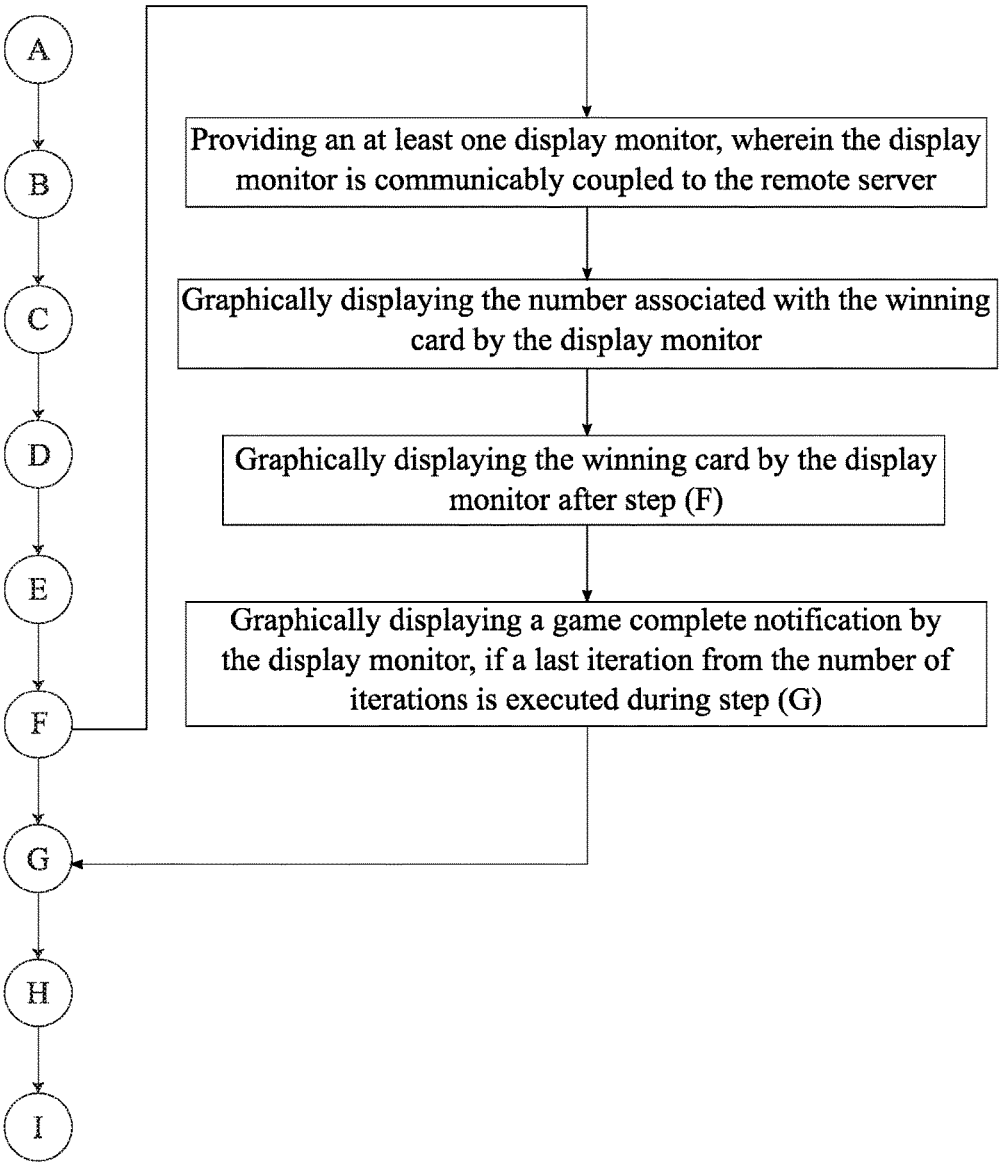
FIG. 4 is a flowchart depicting the steps necessary to graphically display various information to the players through a display monitor.

Referring to FIG. 4, in order to convey the set of winning numbers to the plurality of user accounts the present invention displays the set of winning numbers and other pertinent information through the display monitor(s). In reference to the overall process of the present invention, the number associated with the winning card and the winning card are graphically displayed by the display monitor after Step F. This continuously updates the plurality of user accounts, the players, on the progress of the game. When the complete set of winning numbers are registered, the present invention ends the game. More specifically, if a last iteration from the number of iterations is executed during Step G, then a game complete notification is displayed by the display monitor, thus ending the game.

Figure 6:
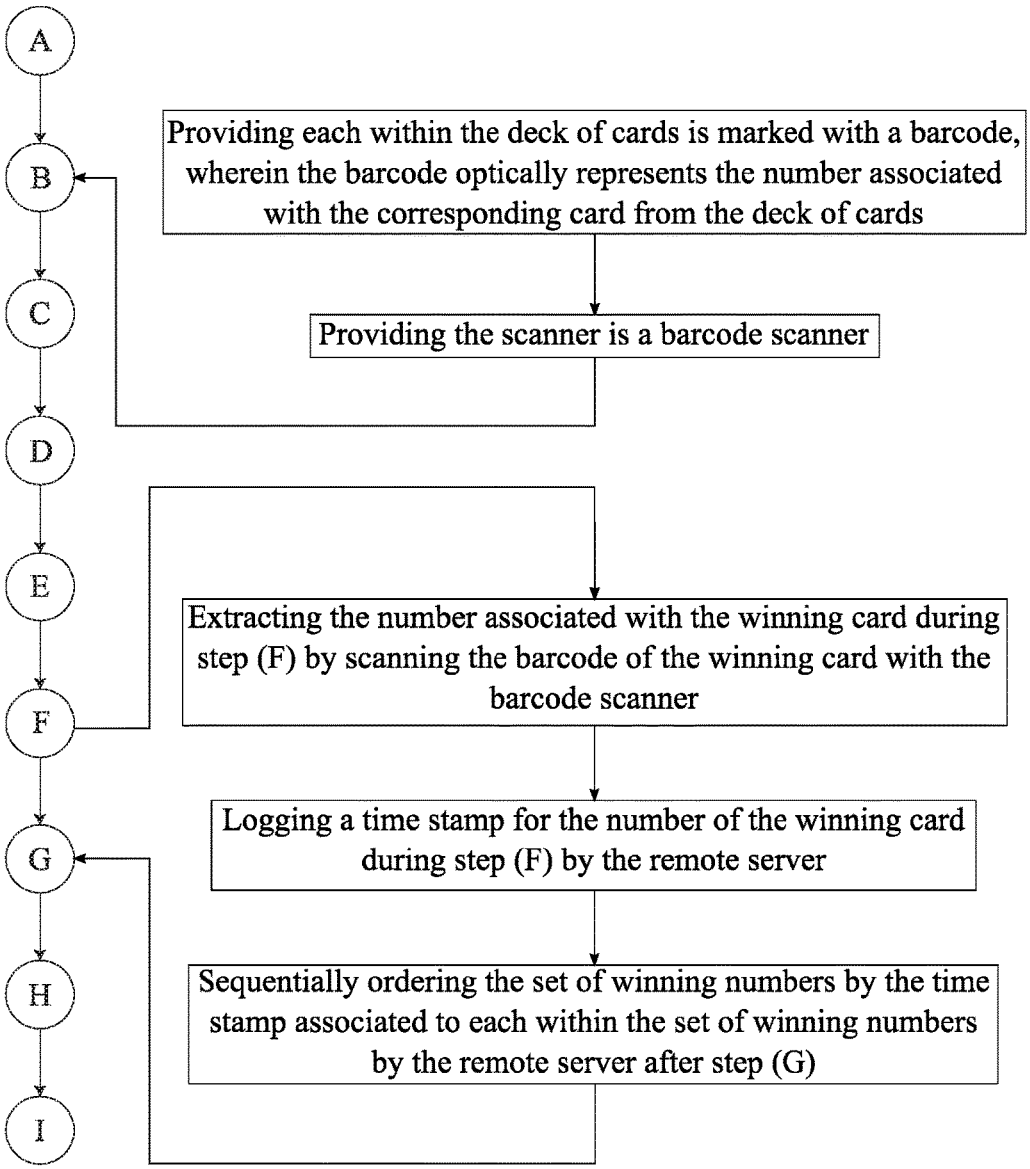
FIG. 6 is a flowchart depicting the steps necessary to extract the number of the winning card and sort the set of winning numbers based on a corresponding time stamp.

A variety of different types of scanners may be used by the present invention. In one embodiment of the present invention, the scanner is a barcode scanner. In this embodiment as seen in FIG. 6, each within the deck of cards is marked with a barcode, wherein the barcode optically represents the number associated with the corresponding card from the deck of cards. During Step F, the number associated with the winning card is extracted by scanning the barcode of the winning card with the barcode scanner, this is done by the dealer or another administrative entity. Once scanned, a time stamp for the number of the winning card is also logged by the remote server during F. After Step G, the set of winning numbers are ordered by the time stamp associated to each within the set of winning numbers by the remote server. This allows the remote server to determine payouts based on various play options as some play options depend on the player guessing specific numbers in a specific order. In alternative embodiments of the present invention, near frequency communication (NFC) technology is utilized to scan the winning cards.

Figure 8:
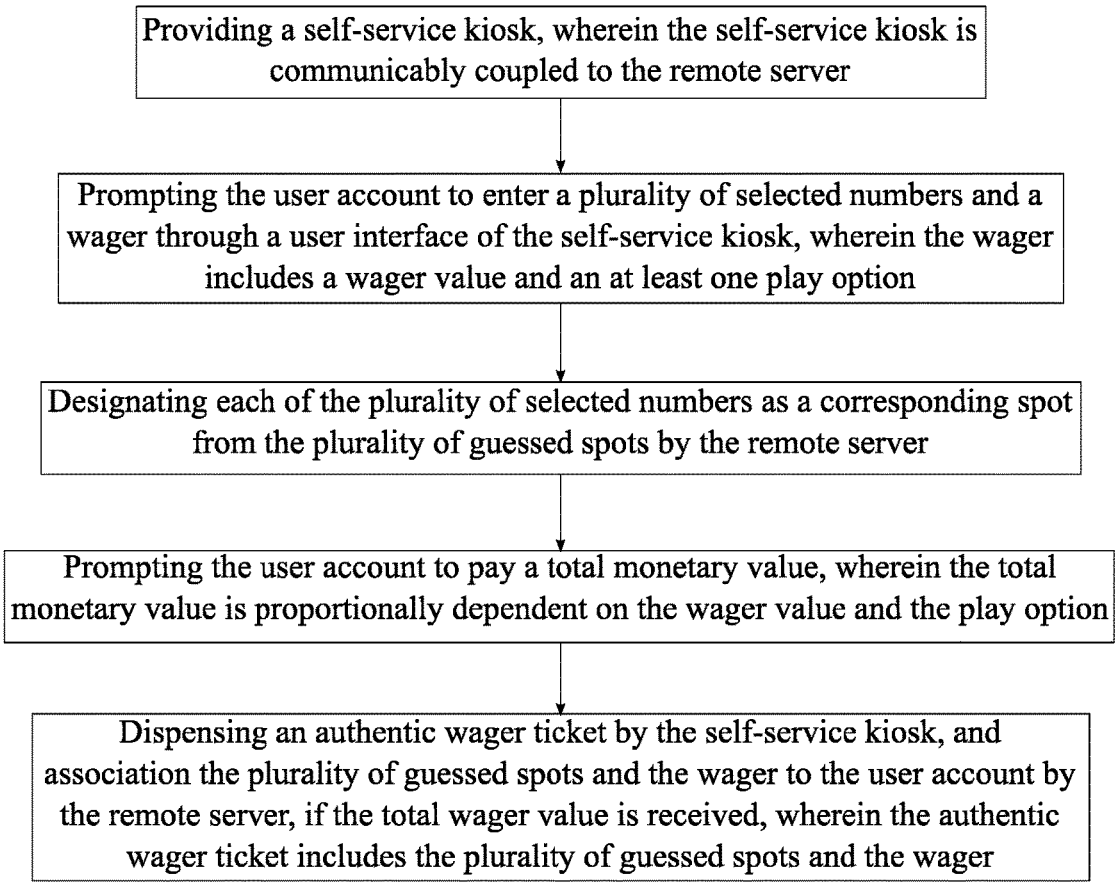
FIG. 8 is a flowchart depicting the steps necessary for a player to register with the present invention through a self-service kiosk.

Referring to FIG. 8, players may register with the present invention through the self-service kiosk. Similar to the overall process of the present invention, the registration process is disclosed in regards to a single user account. First, the player creates registers through the self-service kiosk in order to create a user account within the system. This may include submitting personal information including, but not limited to, name, phone number, email address, and other pertinent information. Once created, the user account is then prompted to enter a plurality of selected numbers and a wager through a user interface of the self-service. Each of the plurality of selected numbers is then designated as a corresponding spot from the plurality of guessed spots by the remote server. A variety of mechanisms and devices may be used as the user interface of the self-service kiosk including, but not limited to, a mouse, a keyboard, a touchscreen, an integrated monitor, and other similar technologies. The wager includes a wager value and an at least one play option. The wager value is the amount of money the player wishes to bet. The play option is the version of the game the player wishes to play. The present invention may implement a variety of play options, similar to traditional keno games. For example, the player may choose to guess three numbers only as the play option. The player is not limited to the number of play options he or she wishes to engage with. Once the play option(s) and the wager value are selected, the user account is then prompted to pay a total monetary value, wherein the total monetary value is proportionally dependent on the wager value and the play option(s). If the total monetary value is received, then the self-service kiosk dispenses an authentic wager ticket. Additionally, the remote server associates the plurality of guessed spots and the wager to the user account. The authentic wager ticket is the physical ticket for the player and includes the plurality of guessed spots, the wager, and other pertinent information. Alternatively, in other embodiments of the present invention, the player submits a wager ticket and the total monetary value to the self-service kiosk in order to authenticate the wager ticket. Furthermore, a server or another personnel may execute the aforementioned registration steps, similar to traditional keno games.

Figure 7:
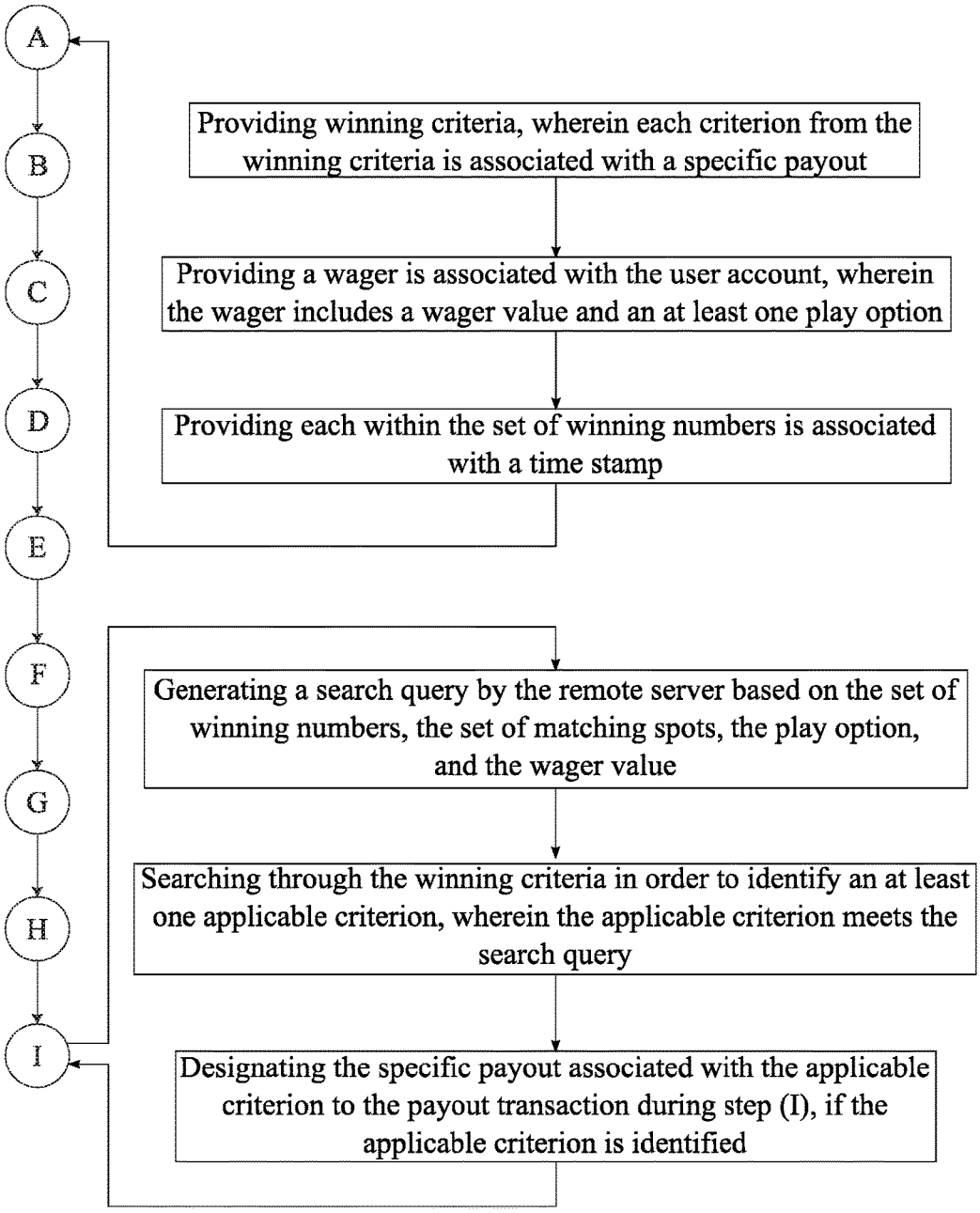
FIG. 7 is a flowchart depicting the steps necessary to identify if the user account won based on winning criteria.

Referring to FIG. 7, the present invention decides if the user account is a winner based on winning criteria. The winning criteria is stored and managed by the remote server. Each of the winning criteria is associated with a specific payout, similar to traditional keno games. Once the game is completed, a search query is generated by the remote server based on the set of winning numbers, the play option associated to the user account, and the wager value associated with the user account. The remote server then searches through the winning criteria in order to identify an at least one applicable criterion, wherein the applicable criterion meets the search query. If the applicable criterion is identified, then the specific payout associated with the applicable criterion is designated as the payout transaction during Step J.

Second Description of Present Invention

The present invention generally relates to casino and card games. More specifically, the present invention is a method for simulating a traditional casino keno game experience using a specially designed deck of playing cards. The present invention implements a traditional keno game in the form of cards. A method and a system are used to achieve this. The method is a sequence of steps, executed in a specific order to simulate a traditional keno game with a dedicated and specialized deck of cards. The system comprises the physical components necessary for the method of the present invention.

The present invention may be implemented for a single or a multitude of players. For simplicity purposes, the general method of the present invention is described for a single player, hereafter referred to as a user account. The user account is associated with a plurality of guessed spots that appear on a traditional Keno card, wherein the plurality of guessed spots represents the player's guesses for the winning numbers (Step AA).

Figure 11:
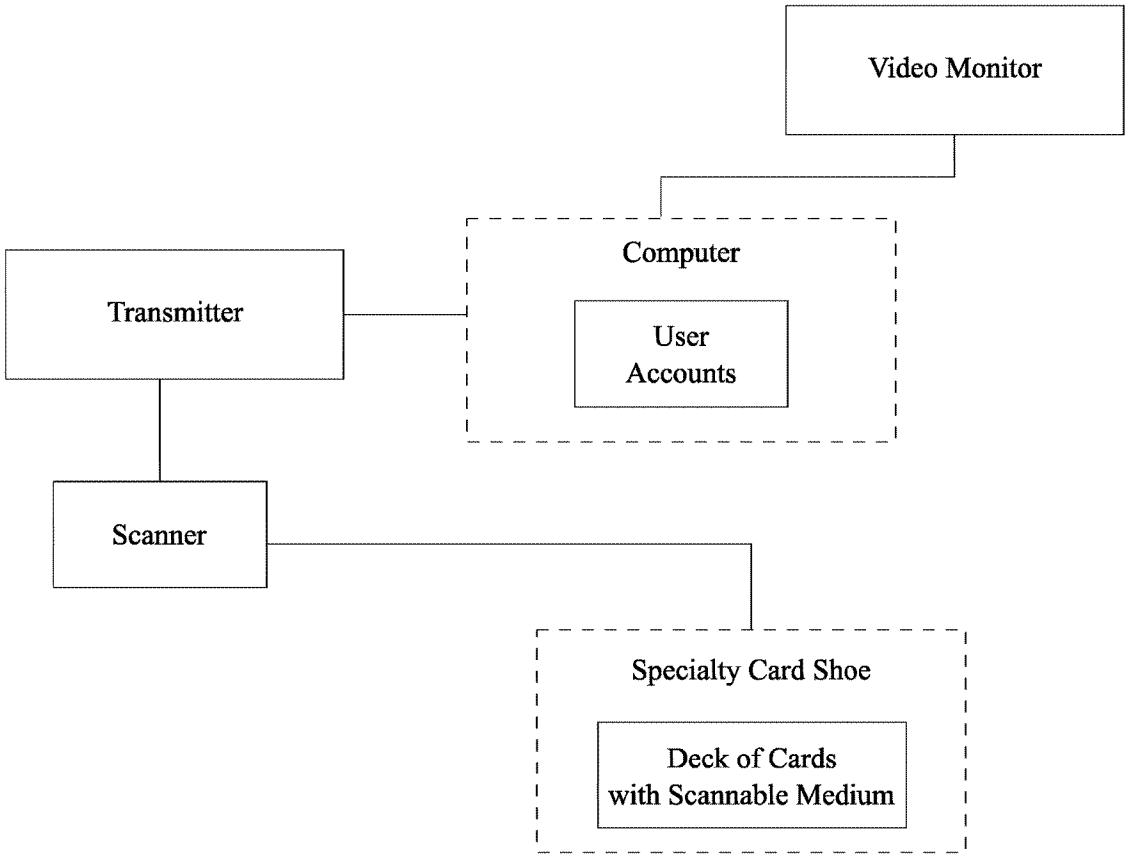
FIG. 11 is a schematic diagram of an alternative embodiment of the present invention.

Referring to FIG. 11, the system comprises a specially designed deck of eighty cards, a computer, a specialty card shoe, a scanner, an at least one video monitor, and a self-service kiosk. The specially designed deck of eighty cards represents and replaces traditional plastic balls used in keno games; each of the cards in the deck contains a unique number that is associated with a spot on a traditional Keno card. More specifically, the present invention uses a specially designed set of eighty playing cards wherein the unique numbers of the specially designed deck of eighty cards number one through eighty, complimentary to a traditional Keno card. There are no repeating numbers within the deck of cards. The size, design, and color of the cards is subject to change depending on the needs and preferences of the user(s). The computer manages the user account and is communicably coupled to the specialty card shoe, the scanner, the video monitor, and the self-service kiosk. The specialty card shoe is a card shuffle machine which randomly rearranges the specially designed deck of eighty cards. In general, the specialty card shoe simulates dispensing random plastic balls in a traditional keno game by dispensing a random card.

The scanner extracts information associated with each of the cards, i.e. the number associated with each of the drawn cards. This information is then utilized by the computer to determine if the user account won or lost. The video monitor graphically displays various information from the present invention including, but not limited to, drawn cards, drawn numbers, progressive pot value, timer, and other relevant information. It is preferred that the drawn numbers are displayed on a traditional Keno card layout in order to simulate a traditional keno game. A variety of devices may be used as the video monitor including, but not limited to, flat panel liquid crystal displays (LCD), light-emitting diode (LED) displays, plasma screens, and other electronic video monitors. The self-service kiosk acts as the physical interface for the players of the present invention. Through the self-service kiosk, the player may create the user account within the present invention and use said account to play. In particular, through the user account and the self-service kiosk, the player may submit his or her number guesses, associated bets, check game and personal bet status, submit payment, and receive monetary winnings.

Figure 9:
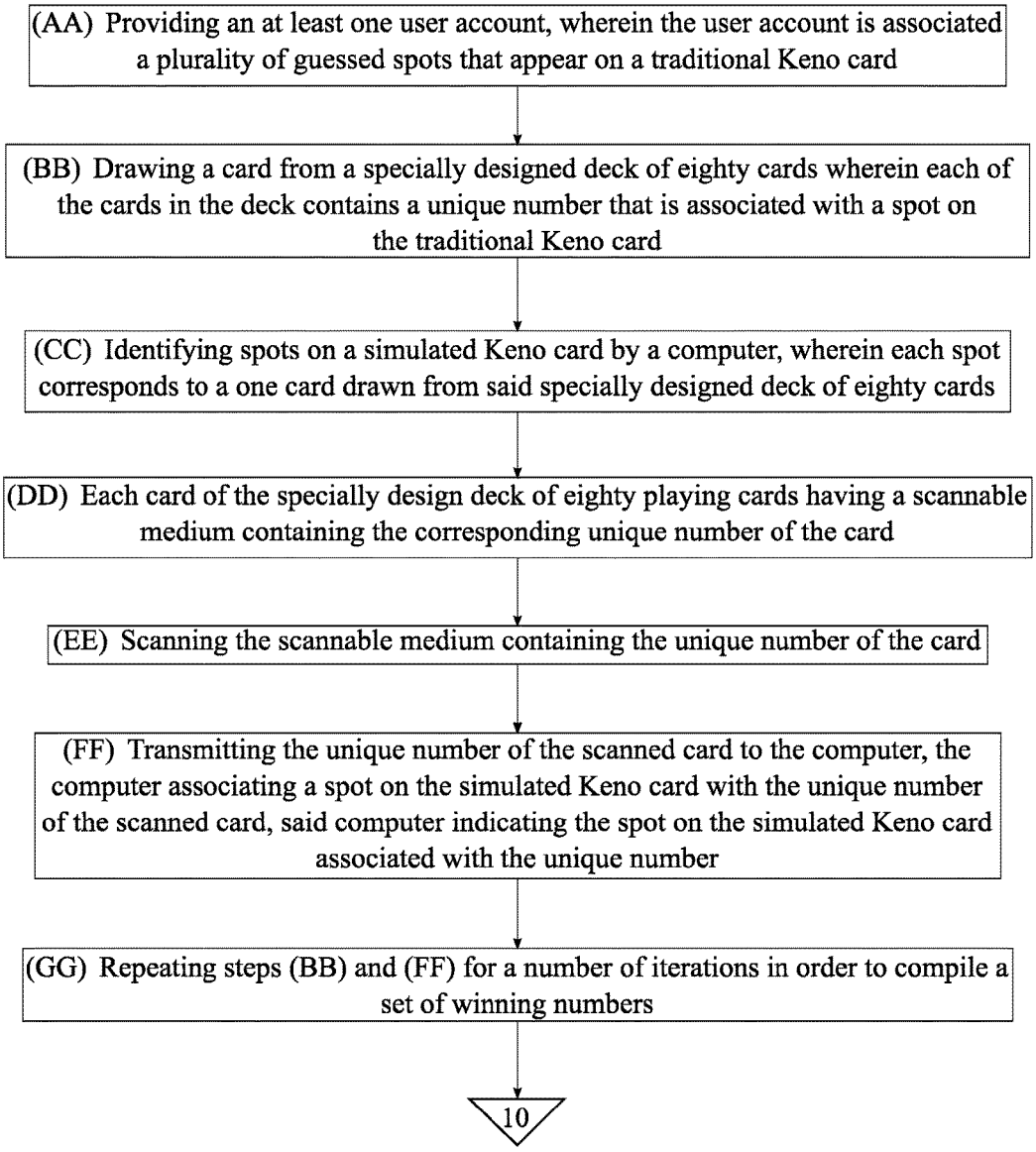
FIG. 9 is a flowchart depicting the overall process for the present invention.
Figure 10:
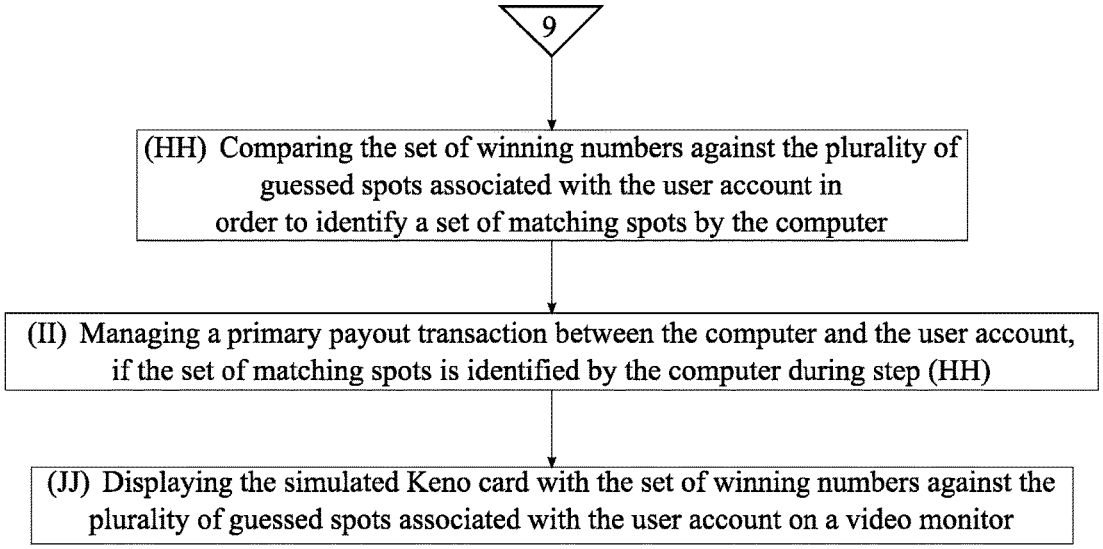
FIG. 10 is a flowchart depicting the overall process for the present invention.

The overall method of the present invention is depicted in FIG. 9 and FIG. 10. Prior to the initiating the game, the player utilizes the self-service kiosk in order to register and submit his or her guesses, i.e. the plurality of guessed spots associated with the user account. Once the game is initiated, by the computer, the specialty card shoe, or a dealer, the deck of cards is first shuffled by the specialty card shoe. This is equivalent to the ball machine and random number generators used in traditional keno games. Next, a card is drawn from the specially designed deck of eighty cards (Step BB). This mimics a random ball being chosen/dispensed in a traditional Keno game. Next, spots are identified on a simulated Keno card by the computer, wherein each spot correspond to a one card drawn from said specially designed deck of eighty cards (Step CC). This simulates a traditional Keno card for the player(s). In order for the system to be able to identify the drawn card, each card of the specially designed deck of eighty playing cards has a scannable medium containing the corresponding unique number of the card (Step DD). Next, the unique number associated with the card is extracted by scanning the scannable medium containing the unique number of the card (Step EE). More specifically, the dealer passes the card by the scanner in order to extract information from the card, i.e. the unique number of the card. This information is then transmitted and processed by the computer. First, the unique number of the scanned card is transmitted to the computer; then, the computer then associates a spot on the simulated Keno card with the unique number of the scanner card; and finally, said computer indicates the spot on the simulated Keno card associated with the unique number (Step FF). The unique number of the Step FF may be transmitted through a wired or wireless connected to the computer. Step FF essentially logs which card from the deck of cards was drawn and displays said card and the unique number of the said card on the simulated Keno card through the video monitor. This process, Steps EE and FF, are then repeated for a number of iterations in order to compile the number of the winning card from each iteration into a set of winning numbers (Step GG). In other words, each iteration corresponds to a different card being dispensed and scanned. Additionally, for each iteration, the card is also physically placed onto a drawn card space on the game table for players and surveillance to see, this is done by the dealer. Similar to the traditional Keno game, the number of iterations executed during Step GG is preferably twenty iterations, thus producing twenty numbers within the set of winning numbers. Next, the set of winning numbers are used to determine and identify if the user account, the player, won or lost their respective bet. The set of winning numbers is compared against the plurality of guessed spots associated with the user account in order to identify a set of matching spots by the computer (Step HH). The set of matching spots includes guessed spots submitted by the user account that are present within the set of winning numbers.

Next, the present invention managing payouts for the user account. More specifically, if the set of matching spots is identified by the computer during Step HH, then a primary payout transaction is managed in between the computer and the user account. The value of the primary payout transaction is dependent on a variety of factors including, but not limited to the number of matching spots, which numbers within the set of winning numbers were identified, the play options the user account chose, and other relevant information. In the preferred embodiment of the present invention, the value of the primary payout transaction is determined based on traditional rules and regulations of a Keno game. One of the regulations for traditional keno games is rewarding players for not guessing any of the winning numbers. For this regulation, if each of the winning numbers is not found amongst the plurality of guessed spots, then a secondary payout transaction is managed between the computer and the user account. Often the value of the secondary payout transaction is significantly less than the value of the primary payout transaction. Finally, the simulated Keno card with the set of winning numbers is displayed against the plurality of guessed spots associated with the user account on the video monitor for the player and spectators to view the results of the game (Step JJ).

The present invention can and is designed to be played by a multitude of players. In regards to the overall process, the present invention is designed for a plurality of user accounts. This is accomplished by executing Steps HH through II for each of the plurality of user accounts, wherein each of the plurality of user accounts represents a specific player.

In order to convey the set of winning numbers to the plurality of user accounts the present invention displays the set of winning numbers and other pertinent information through the video monitor(s). In particular, the set of winning numbers is graphically displayed by the video monitor. This continuously updates the plurality of user accounts, the players, on the progress of the game. When the complete set of winning numbers is registered, the present invention ends the game. More specifically, if a last iteration from the number of iterations is executed during Step GG, then a game complete notification is displayed by the video monitor, thus ending the game.

A variety of different types of scanners may be used by the present invention. In one embodiment of the present invention, the scanner is a barcode scanner. In this embodiment, the scannable medium is a barcode, wherein the barcode optically represents the unique number associated with the corresponding card from the deck of cards. During Step EE, the unique number associated with the card is extracted by scanning the barcode of said winning card with the barcode scanner, this is done by the dealer or another administrative entity. Once scanned, a time stamp for said card is also logged by the computer during EE. After Step GG, the set of winning numbers are ordered by the time stamp associated to each within the set of winning numbers by the computer. This allows the computer to determine payouts based on various play options as some play options depend on the player guessing specific numbers in a specific order. In alternative embodiments of the present invention, the scannable medium is a radio-frequency identification (RFID) device and complimentary technology is used to scan said RFID device.

Players may register with the present invention through the self-service kiosk. Similar to the overall process of the present invention, the registration process is disclosed in regards to a single user account. First, the player registers through the self-service kiosk in order to create a user account within the system. This may include submitting personal information including, but not limited to, name, phone number, email address, and other pertinent information. Once created, the user account is then prompted to enter a plurality of selected numbers and a wager through a user interface of the self-service. Each of the plurality of selected numbers is then designated as a corresponding spot from the plurality of guessed spots by the computer. A variety of mechanisms and devices may be used as the user interface of the self-service kiosk including, but not limited to, a mouse, a keyboard, a touchscreen, an integrated monitor, and other similar technologies. The wager includes a wager value and an at least one play option. The wager value is the amount of money the player wishes to bet. The play option is the version of the game the player wishes to play. The present invention may implement a variety of play options, similar to traditional keno games. For example, the player may choose to guess three numbers only as the play option. The player is not limited to the number of play options he or she wishes to engage with. Once the play option(s) and the wager value are selected, the user account is then prompted to pay a total monetary value, wherein the total monetary value is proportionally dependent on the wager value and the play option(s). If the total monetary value is received, then the self-service kiosk dispenses an authentic wager ticket. Additionally, the computer associates the plurality of guessed spots and the wager to the user account. The authentic wager ticket is the physical ticket for the player and includes the plurality of guessed spots, the wager, and other pertinent information. Alternatively, in other embodiments of the present invention, the player submits a wager ticket and the total monetary value to the self-service kiosk in order to authenticate the wager ticket. Furthermore, a server or another personnel may execute the aforementioned registration steps, similar to traditional keno games.

The present invention decides if the user account is a winner based on winning criteria. The winning criteria is stored and managed by the computer. Each of the winning criteria is associated with a specific payout, similar to traditional Keno games. Once the game is completed, a search query is generated by the computer based on the set of winning numbers, the play option associated to the user account, and the wager value associated with the user account. The computer then searches through the winning criteria in order to identify an at least one applicable criterion, wherein the applicable criterion meets the search query. If the applicable criterion is identified, then the specific payout associated with the applicable criterion is designated as the payout transaction during Step II.

Additionally, in one embodiment of the present invention, at least one deck of eighty playing cards is utilized, wherein each card further comprises a scannable medium containing a unique number for each card of the at least one deck of eighty playing cards. Furthermore, a transmitter is also used. The transmitter allows for the unique number of the scanned card to be transmitted to the computer. In this embodiment, the specialty card shoe repeats the steps of scanning and transmitting the unique numbers of playing cards from the at least one deck of eighty playing cards for a total of twenty iterations. When the twenty iterations are reached, the specialty card shoe ceasing scanning functions.

Although the invention has been explained in relation to its preferred embodiment, it is to be understood that many other possible modifications and variations can be made without departing from the spirit and scope of the invention as hereinafter claimed.

What is claimed is:

1. A method for simulating a traditional casino keno game experience using a dedicated set of playing cards comprising the step of:

(A) providing at least one user account, the at least one user account being associated with a plurality of guessed spots;

(B) providing a deck of cards, each of the cards being associated with a number;

(C) providing a remote server, a card shuffle machine and a scanner, the remote server managing the at least one user account and being communicably coupled to the card shuffle machine and the scanner;

(D) shuffling the deck of cards by the card shuffle machine;

(E) dispensing a winning card by the card shuffle machine;

(F) extracting the number associated with the winning card by the scanner;

(G) repeating steps (E) and (F) for a number of iterations in order to compile the number of the winning card from each iteration into a set of winning numbers;

(H) comparing the set of winning numbers against the plurality of guessed spots associated with the at least one user account in order to identify a set of matching spots by the remote server;

(I) managing a primary payout transaction between the remote server and the at least one user account in response to the set of matching spots being identified by the remote server during step (H);

providing each within the deck of cards being marked with a near frequency communication (NFC) tag, the NFC tag representing the number associated with the corresponding card from the deck of cards;

providing the scanner being a near frequency communication (NFC) reader;

extracting the number associated with the winning card during step (F) by scanning the NFC tag of the winning card with the NFC reader;

providing winning criteria, each criterion from the winning criteria being associated with a specific payout;

providing a wager being associated with the at least one user account, the wager including a wager value and an at least one play option;

providing each within the set of winning numbers being associated with a time stamp;

generating a search query by the remote server based on the set of winning numbers, the set of matching spots, the play option and the wager value;

searching through the winning criteria in order to identify an at least one applicable criterion, the applicable criterion meeting the search query; and designating the specific payout associated with the applicable criterion to the payout transaction during step (I) in response to the applicable criterion being identified.

2. The method for simulating a traditional casino keno game experience using a dedicated set of playing cards as claimed in claim 1 comprising the step of:

(J) managing a secondary payout transaction between the remote server and the at least one user account in response to each of the winning numbers being not found amongst the plurality of guessed spots.

3. The method for simulating a traditional casino keno game experience using a dedicated set of playing cards as claimed in claim 1 comprising the step of:

providing at least one display monitor, the at least one display monitor being communicably coupled to the remote server;

graphically displaying the number associated with the winning card by the at least one display monitor;

graphically displaying the winning card by the at least one display monitor after step (F); and graphically displaying a game complete notification by the at least one display monitor in response to a last iteration from the number of iterations being executed during step (G).

4. The method for simulating a traditional casino keno game experience using a dedicated set of playing cards as claimed in claim 1 comprising the step of:

the at least one user account being a plurality of user accounts, the plurality of user accounts being managed by the remote server; and executing steps (H) and (I) for each of the plurality of user accounts.

5. The method for simulating a traditional casino keno game experience using a dedicated set of playing cards as claimed in claim 1 comprising the step of:

logging the time stamp for the number of the winning card during step (F) by the remote server; and sequentially ordering the set of winning numbers by the time stamp associated to each within the set of winning numbers by the remote server after step (G).

6. The method for simulating a traditional casino keno game experience using a dedicated set of playing cards as claimed in claim 1 comprising the step of:

providing a self-service kiosk, the self-service kiosk being communicably coupled to the remote server;

prompting the at least one user account to enter a plurality of selected numbers and the wager through a user interface of the self-service kiosk, the wager including the wager value and the at least one play option;

designating each of the plurality of selected numbers as a corresponding spot from the plurality of guessed spots by the remote server;

prompting the at least one user account to pay a total monetary value, the total monetary value being proportionally dependent on the wager value and the play option; and dispensing an authentic wager ticket by the self-service kiosk, and association the plurality of guessed spots and the wager to the at least one user account by the remote server in response to the total wager value being received, the authentic wager ticket including the plurality of guessed spots and the wager.

7. The method for simulating a traditional casino keno game experience using a dedicated set of playing cards as claimed in claim 1, wherein the deck of cards includes 80 cards.

8. The method for simulating a traditional casino keno game experience using a dedicated set of playing cards as claimed in claim 1, wherein number of iterations executed during step (G) is 20 iterations.

* * * * *